US005465699A

United States Patent [19]

Voigt

[11] Patent Number: 5,465,699

[45] Date of Patent: Nov. 14, 1995

[54] INTAKE PIPE ARRANGEMENT FOR AN INTERNAL COMBUSTION ENGINE HAVING INDIVIDUAL ARC-SHAPED CYLINDER INTAKE PIPES

[75] Inventor: Dieter Voigt, Wolfsburg, Germany

[73] Assignee: Volkswagen AG, Wolfsburg, Germany

[21] Appl. No.: 232,618

[22] Filed: Apr. 25, 1994

[30] Foreign Application Priority Data

Jun. 1, 1993 [DE] Germany ..... 43 18 159.7

[51] Int. Cl.[6] ..... F02M 37/04

[52] U.S. Cl. ..... 123/470; 123/531

[58] Field of Search ..... 123/470, 472, 123/469, 468, 456, 531

[56] References Cited

U.S. PATENT DOCUMENTS

| | | | |
|---|---|---|---|
| 4,369,747 | 1/1983 | Jahoda | 123/531 |
| 4,576,131 | 3/1986 | Sugiyama | 123/432 |
| 4,898,125 | 2/1990 | Ampferer . | |
| 4,909,221 | 3/1990 | Heuser | 123/470 |
| 4,966,120 | 10/1990 | Itoh | 123/470 |
| 5,231,958 | 8/1993 | Takahashi et al. . | |
| 5,357,931 | 10/1994 | Semence | 123/470 |

FOREIGN PATENT DOCUMENTS

| | | | |
|---|---|---|---|
| 0182223 | 11/1987 | European Pat. Off. . | |
| 0307571 | 7/1988 | European Pat. Off. . | |
| 0501612 | 1/1992 | European Pat. Off. . | |
| 966414 | 10/1950 | France | 123/531 |
| 7142218 | 11/1971 | Germany . | |
| 4224908 | 2/1993 | Germany . | |
| 52-15492 | 1/1977 | Japan . | |
| 0152168 | 9/1983 | Japan | 123/470 |
| 0200062 | 11/1984 | Japan | 123/470 |
| 59-43923 | 12/1984 | Japan . | |
| 0215960 | 12/1984 | Japan | 123/470 |
| 60-18775 | 9/1985 | Japan . | |
| 4101063 | 4/1992 | Japan | 123/531 |
| 2142089 | 1/1985 | United Kingdom . | |

OTHER PUBLICATIONS

French Preliminary Search Report dated Feb. 10, 1995 in Application No. FR 9406543 (translation attached).

*Primary Examiner*—Carl S. Miller

*Attorney, Agent, or Firm*—Brumbaugh, Graves, Donohue & Raymond

[57] ABSTRACT

An intake pipe arrangement for an internal combustion engine having a cylinder head includes individual arc-shaped cylinder intake pipes which surround corresponding fuel-injection valves. A fuel-distributor line for the injection valves is integrated as a bore in a wall region of the intake tubes and the wall region has recesses in which the injection valves are received. The end regions of the injection valves which have spray bores project into recesses in an intermediate flange which is designed so that the flange, after insertion of the opposite ends of the injection valves into the recesses in the wall regions of the intake pipes, can be connected with the cylinder head ends of the intake pipes to provide a subassembly unit.

6 Claims, 3 Drawing Sheets

INTAKE PIPE ARRANGEMENT FOR AN INTERNAL COMBUSTION ENGINE HAVING INDIVIDUAL ARC-SHAPED CYLINDER INTAKE PIPES

BACKGROUND OF THE INVENTION

This invention relates to intake pipe arrangements for internal combustion engines having arc-shaped cylinder intake pipes.

German Utility Model No. 71 42 218 and European Patent No. 0 307 571 disclose arc-shaped intake pipe arrangements for internal combustion engines which have the advantage that the fuel-conducting elements, i.e., the fuel-distributor line and the fuel-injection valves, are embraced by the arc-shaped intake pipes and therefore are protected against damage in, for example, a collision involving a vehicle equipped with the engine. On the other hand, the size of the intake pipes, which essentially determines the outer dimensions of the internal combustion engine, is largely predetermined by the space required for the accommodation and assembly of the fuel injection valves, as well as, in head-fed fuel-injection valves, for the fuel-distributor line. In the arrangement disclosed in the above cited German utility model, the injection valves project deeply into additional intake passages on the cylinder head and are mounted therein, whereas, in the arrangement disclosed in the above-cited European patent, the end regions of the fuel-injection valves containing the spray bores are received in bores in the cylinder head, and the fuel-distributor line connected with the intake ends of the injection valves is attached by flanges to the cylinder head. In these arrangements, separation of the arc-shaped intake tubes is required to mount the fuel-injection valves and the distributor line and a great deal of space is required to accommodate the distributor line and injection valves.

SUMMARY OF THE INVENTION

Accordingly, it is an object of the present invention to provide an intake pipe arrangement for an internal combustion engine having arc-shaped cylinder intake pipes which overcomes the above-mentioned disadvantages of the prior art.

Another object of the invention is to provide a compact intake pipe arrangement which includes the advantageous features of the prior art while utilizing a subassembly unit of intake pipes, fuel-distributor line and fuel-injection valves to facilitate assembly.

These and other objects of the invention are attained by providing an intake pipe arrangement having arc-shaped intake pipes in which one end of a fuel-injection valve is received in a recess formed in the wall of an arc-shaped intake pipe.

Thus, the disadvantages of the prior art described are avoided by supporting the fuel-injection valves in recesses which are provided in the wall regions of the arc-shaped intake tubes which face the injection valves. If these wall regions of adjacent intake pipes are continuous, a fuel-distributor line common to all of the valves accommodated in the adjacent recesses can be provided by a longitudinal bore.

In principle, it is possible to have the opposite end regions of the injection valves, which are provided with the spray openings, project into corresponding recesses in the cylinder head. However, to provide a subassembly unit containing the arc-shaped intake pipes and the injection valves which is assembled as a unit with the internal combustion engine, it is advantageous to provide an intermediate flange which is arranged so that, after insertion of the fuel-injection valves into the recesses in the wall of the intake pipe, the intermediate flange can be positioned over the injection valves and mounted on facing end regions of the arc-shaped intake pipes. This subassembly unit is then mounted on the cylinder head of the internal combustion engine.

The reduction in the radius of curvature of the arc-shaped intake pipes obtained by providing such an intermediate flange does not adversely affect the adaptability of the intake pipe arrangement to various conditions. For example, it is possible to provide air-supported or air-surrounded fuel injection by including an air-supply bore in the intermediate flange which is in flow communication with antechambers formed in the intermediate flange at a location upstream from the spray bores of the injection valves. If foot-fed injection valves are used, a fuel-distributor line may be accommodated at that location.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
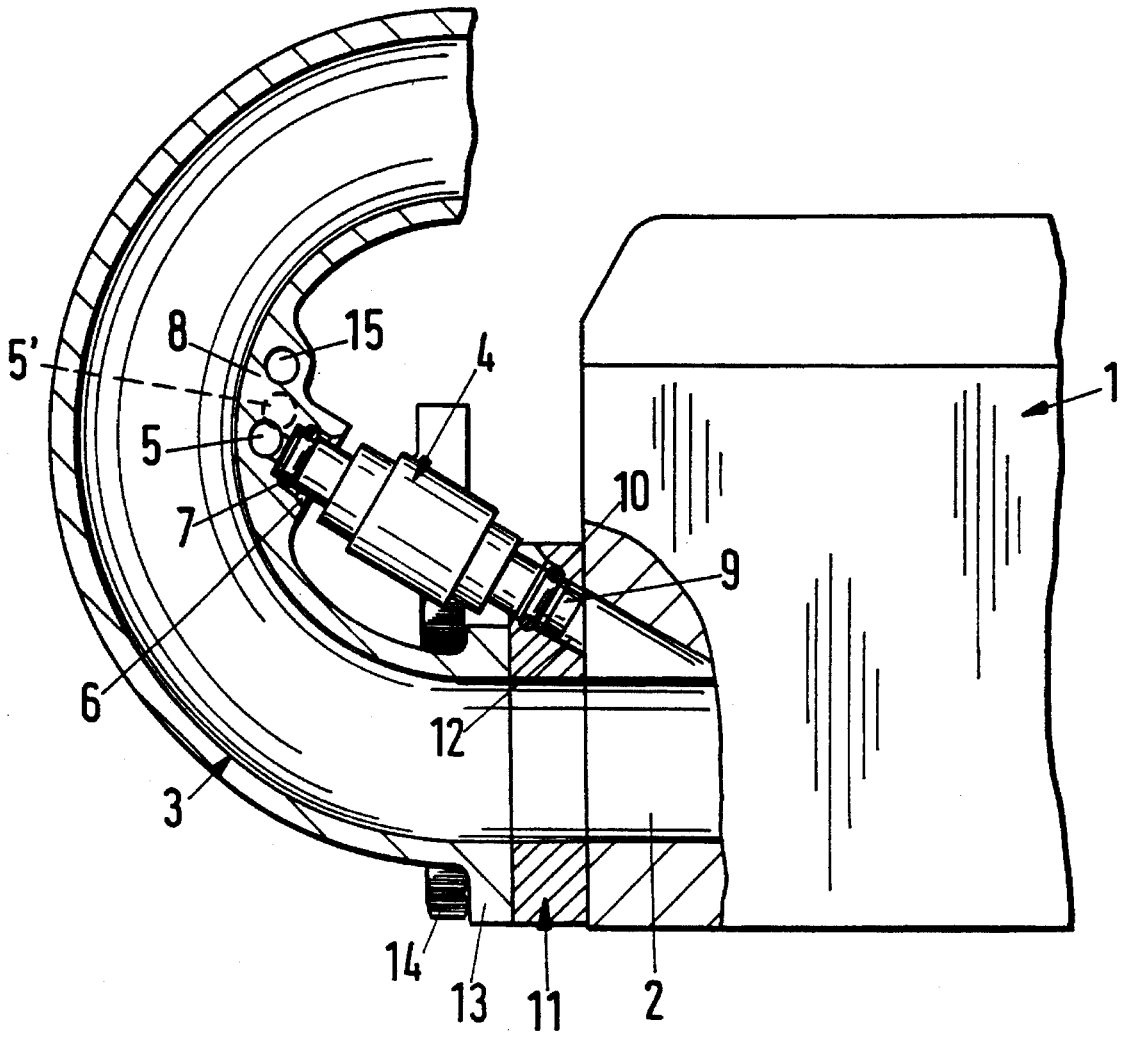
FIG. 1 is a cross-sectional view showing a representative embodiment of an intake pipe arrangement according to the invention.

In the representative embodiment of the invention shown in FIG. 1, a cylinder head 1 has an inlet channel 2 for each cylinder to which combustion air is supplied through an arcshaped into pipe 3 and fuel is supplied to the air through an injection valve 4 in the usual way. Accordingly, the cylinder head is supplied with combustion air through a number of inlet channels 2 and intake pipes 3 corresponding to the number of cylinders in the engine.

To supply fuel to each of the injection valves 4, a bore 5, extending in a direction parallel to the cylinder head 1 and to the internal combustion engine, i.e., perpendicular to the plane of the drawing, is formed in the walls of the arc-shaped suction pipes 3 and communicates with a recess 6 in each intake pipe wall, and a sealing ring 7 at the intake end of the injection valve 4 seals the opening into which the valve is received against leakage. The fuel supply bore 5, like the recess 6, is formed within a wall region 8 of the arc-shaped intake pipe 3 which constitutes a reinforced wall portion of thicker cross-section.

It will be noted that, because of the integration of the fuel-distribution line as a bore 5 in the wall of the intake pipe 3, the distance between the inner wall region 8 of the intake pipes 3 and the cylinder head 1, and hence the lateral projection of the arc-shaped intake pipe 3 from the engine, is minimized. Moreover, no separate assembly for the fuel-conducting parts of the arrangement is required.

As previously described, it is possible to insert the injection end 9 of the fuel-injection valve 4, which has at least one fuel-delivery bore, and a corresponding sealing ring 10 directly into a corresponding bore of the cylinder head 1. To provide a subassembly unit consisting of the arc-shaped intake pipes 3 and the injection valves 4, the illustrated embodiments of the invention include an intermediate flange 11 which is formed with a recess 12 to receive the end region 9 of the corresponding injection valve 4. The valve-receiving recesses are designed so that the flange 11, after the injection valves 4 have been mounted into the associated recesses 6 of the arc-shaped intake pipes 3, can be slipped onto the end regions 9 of the injection valves and then fastened to a common end flange 13 for the intake pipes 3. This subassembly unit is then fastened to the cylinder head 1 by bolts 14, for example.

Furthermore, another bore 15 is also advantageously formed in the wall region 8 to provide a fuel-return line.

By positioning the bore 5 at the location labelled 5' laterally adjacent to the axes of the fuel-injection valves 4, the material of the cross-section of the wall region 8 may, if necessary, be better utilized.

Figure 2:
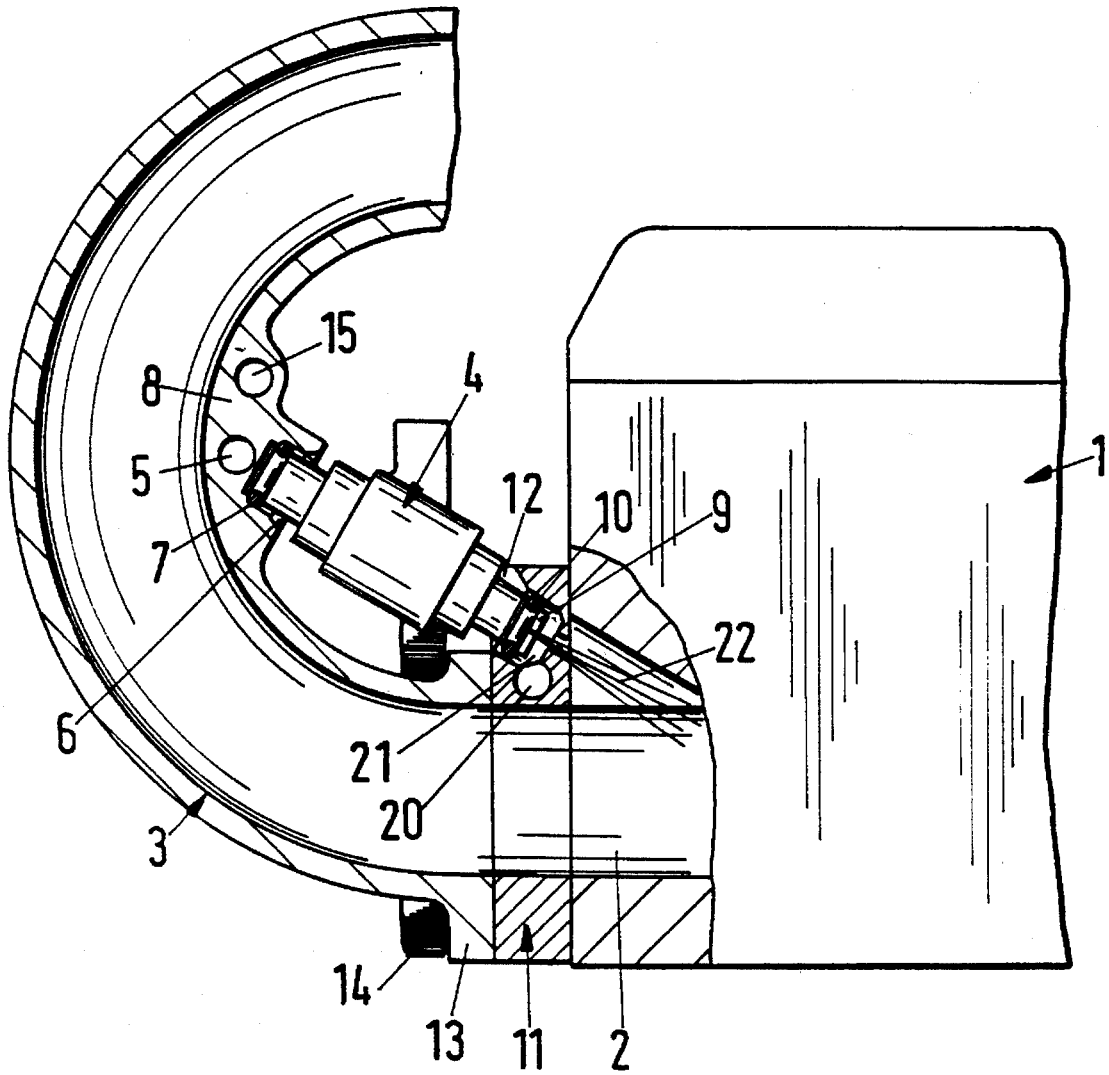
FIG. 2 is a cross-sectional view similar to FIG. 1 showing another representative embodiment of the invention.

The embodiment shown in FIG. 2 differs from that of FIG. 1 only by a modification of the intermediate flange 11 to provide air-surrounded fuel injection. Accordingly, the explanation of the parts described above with respect to FIG. 1 which are provided with the same reference numerals in FIG. 2 will not be repeated.

In the arrangement shown in FIG. 2, the flange 11 is formed with an air-supply bore 20, which is in flow communication with antechambers 21 for each of the injection valves 4. The air-supply bore 20 extends longitudinally parallel to the direction of the cylinder head 1 in the intermediate flange 11. Each antechamber 21 is therefore positioned around the end of the spray bore of the associated valve 4 and causes a sprayed fuel stream 22 to be surrounded by air. As is well-known, this results in an improvement in the fuel mixture. In the case of a lateral air supply to the injection valves, the air-supply bore may alternatively run lateral to the valves.

Figure 3:
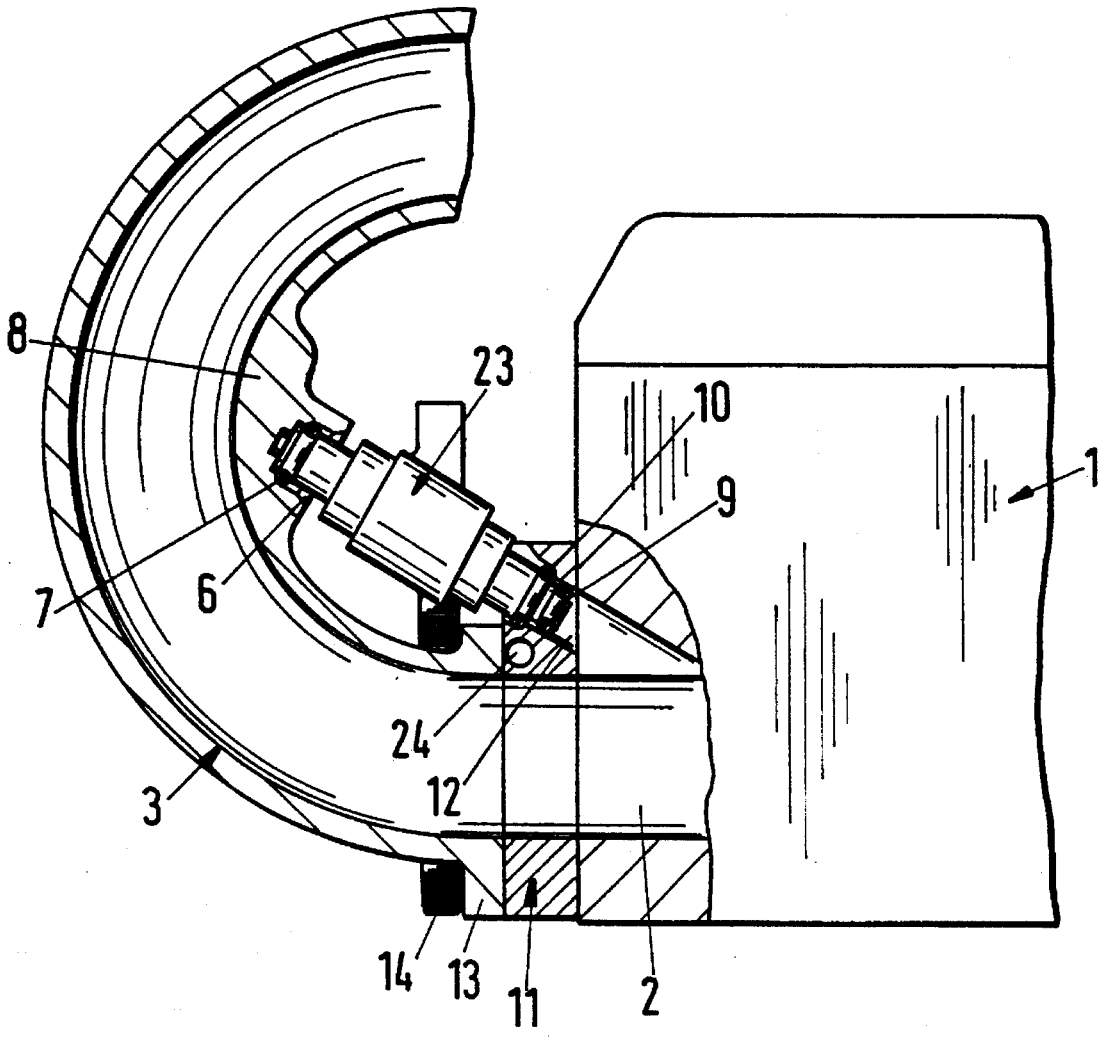
FIG. 3 is a view similar to FIG. 1 and 2 showing a third embodiment of the invention.

Turning now to FIG. 3, there is shown an intake arrangement with food fed injection valves 23. Consequently, a fuel supply bore 24 extends longitudinally parallel to the direction of the cylinder head 1 within the flange 11 near the lower parts ("feet") of all injection valves.

The invention accordingly provides an intake pipe arrangement which is optimized with regard to its dimensions and its ease of assembly.

Although the invention has been described herein with reference to specific embodiments, many modifications and variations therein will readily occur to those skilled in the art. Accordingly, all such variations and modifications are included within the intended scope of the invention.

I claim:

1. An intake pipe arrangement for an internal combustion engine having a cylinder head comprising a plurality of individual arc-shaped cylinder intake pipes communicating with corresponding inlet channels in the cylinder head, each of the intake pipes having an arc-shaped portion with an enlarged inner wall region facing the cylinder head, a corresponding plurality of fuel-supplying injection valves having injection end regions projecting toward recesses in the inlet channels in the cylinder head to supply fuel thereto, a plurality of recesses in the enlarged inner wall regions of the arc-shaped intake pipes coaxial to the cylinder head recesses in which the opposite ends of the fuel-injection valves are received, and an intermediate flange having through-bores axially aligned with the inlet channel recesses to receive the injection end regions of the injection valves adjacent to the cylinder head after insertion of the injection valves into the recesses on the cylinder head-side ends of the intake pipes, the intermediate flange, the plurality of intake pipes and the plurality of fuel-injection valves forming a subassembly mountable as a unit on the cylinder head of an internal combustion engine.

2. An intake pipe arrangement according to claim 1 including a bore formed in the wall regions of the intake pipes and extending longitudinally in a direction parallel to the cylinder head to form a fuel-supply line and communicating with the injection valves through the recesses formed in the intake pipes.

3. An intake pipe arrangement according to claim 2 wherein the bore is laterally displaced from the axes of the injection valves.

4. An intake pipe arrangement according to claim 1 including an air-supply bore in the intermediate flange extending longitudinally in a direction approximately parallel to the cylinder head for air-supported fuel injection.

5. An intake pipe arrangement according to claim 1 including a fuel-distributor line extending longitudinally in a direction approximately parallel to the cylinder head in the intermediate flange to supply fuel to foot-fed fuel-injection valves.

6. An intake pipe arrangement according to claim 1 wherein the cross-section of the intake pipes is reinforced at the wall regions.

* * * * *